US010247207B2

(12) United States Patent
Goto et al.

(10) Patent No.: US 10,247,207 B2
(45) Date of Patent: Apr. 2, 2019

(54) INDUSTRIAL VEHICLE

(71) Applicants: KABUSHIKI KAISHA TOYOTA JIDOSHOKKI, Kariya-shi, Aichi-ken (JP); NISHINA INDUSTRIAL CO., LTD., Nagano-shi, Nagano-ken (JP)

(72) Inventors: Tetsuya Goto, Kariya (JP); Kenichi Hagino, Kariya (JP); Yasushi Kuwano, Kariya (JP); Akihito Nibe, Kariya (JP); Shigeto Nakajima, Nagano (JP); Satoshi Takano, Nagano (JP)

(73) Assignees: KABUSHIKI KAISHA TOYOTA JIDOSHOKKI, Kariya-Shi, Aichi-ken (JP); NISHINA INDUSTRIAL CO., LTD., Nagano-shi, Nagano-ken (JP)

( * ) Notice: Subject to any disclaimer, the term of this patent is extended or adjusted under 35 U.S.C. 154(b) by 211 days.

(21) Appl. No.: 15/340,012

(22) Filed: Nov. 1, 2016

(65) Prior Publication Data

US 2017/0130742 A1 May 11, 2017

(30) Foreign Application Priority Data

Nov. 5, 2015 (JP) ..... 2015-217615

(51) Int. Cl.

| | |
|---|---|
| ***F15B 13/02*** | (2006.01) |
| ***F15B 1/26*** | (2006.01) |
| ***B66F 9/22*** | (2006.01) |
| ***E02F 9/22*** | (2006.01) |

(52) U.S. Cl.

CPC ..... *F15B 1/26* (2013.01); *B66F 9/22* (2013.01); *E02F 9/2228* (2013.01); *E02F 9/2267* (2013.01); *F15B 13/024* (2013.01); *F15B 2211/255* (2013.01); *F15B 2211/40592* (2013.01); *F15B 2211/55* (2013.01)

(58) Field of Classification Search

CPC ..... F15B 13/024; F15B 2211/55

See application file for complete search history.

(56) References Cited

U.S. PATENT DOCUMENTS

| | | | | |
|---|---|---|---|---|
| 5,046,310 | A * | 9/1991 | Kauss | F15B 11/05 60/468 |
| 2014/0322045 | A1* | 10/2014 | Sakamoto | F15B 11/0423 417/364 |
| 2014/0331659 | A1 | 11/2014 | Kato et al. | |

FOREIGN PATENT DOCUMENTS

| | | | |
|---|---|---|---|
| JP | 625298 | U | 4/1994 |
| JP | 08100805 | A | 4/1996 |
| JP | 2010076937 | A | 4/2010 |
| JP | 2012087914 | A | 5/2012 |
| JP | 2014097853 | A | 5/2014 |
| JP | 2014-222079 | A | 11/2014 |

* cited by examiner

*Primary Examiner* — F Daniel Lopez
(74) *Attorney, Agent, or Firm* — Sughrue Mion, PLLC

(57) ABSTRACT

When an engine stall is likely to occur, the pressure of the back pressure chamber of a relief pressure valve is released to adjust the relief pressure of the relief pressure valve. This actuates a pressure compensating circuit to release the pressure in a control circuit to an oil tank. Thus, a rapid increase of the pressure due to a cargo handling operation is restricted, and an engine stall due to insufficient torque of the engine is avoided.

4 Claims, 3 Drawing Sheets

INDUSTRIAL VEHICLE

BACKGROUND OF THE INVENTION

The present invention relates to an industrial vehicle equipped with a hydraulic actuating device.

As this type of industrial vehicles, a forklift is known. The forklift includes an engine, a hydraulic pump driven by the engine, and a hydraulic actuating device actuated by hydraulic oil discharged from the hydraulic pump. The forklift has hydraulic cylinders for moving the fork upward or downward and hydraulic cylinders for tilting the mast assembly. When the hydraulic pump is driven by the engine, engine torque may become insufficient as the load of the hydraulic pump increases, which may cause an engine stall. To address this, Japanese Laid-Open Patent Publication No. 2014-222079 proposes a configuration for avoiding an engine stall. However, the configuration disclosed in Japanese Laid-Open Patent Publication 2014-222079 still has room for improvement.

SUMMARY OF THE INVENTION

An object of the present invention is to provide an industrial vehicle capable of avoiding an engine stall.

To achieve the foregoing objective and in accordance with a first aspect of the present invention an industrial vehicle is provided that includes an engine, a hydraulic pump driven by the engine, an oil tank, which stores hydraulic oil to be pumped by the hydraulic pump, a hydraulic actuating device actuated by hydraulic pressure, a first circuit, which includes a control valve and switches supply and discharge of the hydraulic oil by using the control valve, thereby driving the hydraulic actuating device, a first oil passage, which connects the first circuit to the hydraulic pump, a second circuit, which controls a pressure in the first circuit, a first detecting means, which is used to obtain an engine speed, a second detecting means, which is used to obtain a discharge pressure of the hydraulic pump, and a control device. The second circuit includes a second oil passage, which connects the hydraulic pump to the oil tank without the first circuit in between, a pressure compensating valve, which is located on the second oil passage, a third oil passage, which connects the control valve to the oil tank, a relief pressure valve, which is located on the third oil passage, a fourth oil passage, which is connected to a back pressure chamber of a relief pressure valve, an electromagnetic valve, which is located on the fourth oil passage, and a fifth oil passage, which is located on the third oil passage between the control valve and the relief pressure valve. The fifth oil passage introduces a pressure of the third oil passage into the pressure compensating valve. The control device actuates the electromagnetic valve to open the fourth oil passage when determining that an engine stall is likely to occur based on information of the engine speed obtained from a detection result of the first detecting means and information of the discharge pressure of the hydraulic pump obtained from a detection result of the second detecting means. The industrial vehicle opens the fourth oil passage to actuate the pressure compensating valve such that the hydraulic pump is connected to the oil tank.

DETAILED DESCRIPTION OF THE PREFERRED EMBODIMENTS

First Embodiment

A first embodiment in which an industrial vehicle of the present invention is embodied as a forklift will be described below according to FIG. 1 to FIG. 4.

Figure 1:
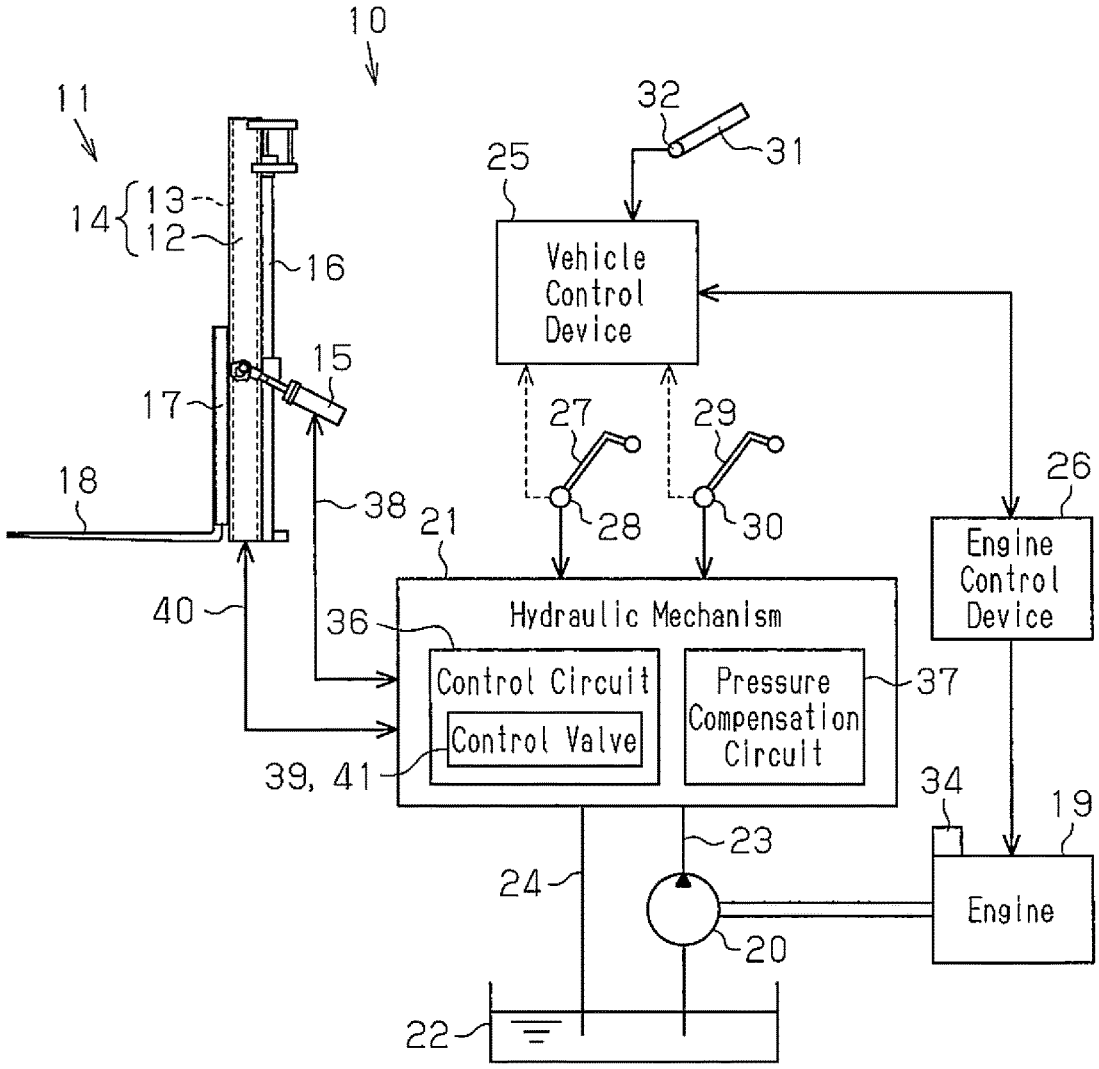
FIG. 1 is a schematic diagram illustrating an overall configuration of a forklift.

As illustrated in FIG. 1, a forklift 10 includes a vehicle body and a cargo handling device 11 mounted on the vehicle body. The cargo handling device 11 includes a multistage mast assembly 14. The multistage mast assembly 14 is constructed of a pair of left and right outer masts 12 and a pair of left and right inner masts 13. A hydraulic tilt cylinder 15 is coupled to each outer mast 12 as a hydraulic actuating device. A hydraulic lift cylinder 16 is coupled to each inner mast 13 as a hydraulic actuating device. When hydraulic oil is supplied to the tilt cylinders 15 or hydraulic oil is discharged from the tilt cylinders 15, the mast assembly 14 tilts in a longitudinal direction of the vehicle body. When hydraulic oil is supplied to the lift cylinders 16 or hydraulic oil is discharged from the lift cylinders 16, the inner masts 13 move in a vertical direction of the vehicle body. A fork 18 as a cargo handling tool is attached to the inner masts 13 via a lift bracket 17. When the lift cylinders 16 are actuated and the inner masts 13 move upward or downward along the outer masts 12, the fork 18 moves upward or downward along with the lift bracket 17.

The vehicle body is equipped with an engine 19, a hydraulic pump 20, and a hydraulic mechanism 21. The engine 19 is a drive source for travelling operation and cargo handling operation of the forklift 10. Hydraulic oil ejected from the hydraulic pump 20 is supplied to the hydraulic mechanism 21. The hydraulic mechanism 21 controls supply and discharge of hydraulic oil to and from the cylinders 15 and 16. An oil passage 23, which is a first oil passage, is connected to the hydraulic pump 20 to supply the hydraulic oil pumped from the oil tank 22 to the hydraulic mechanism 21. The oil passage 23 is connected to a discharge port of the hydraulic pump 20. The hydraulic mechanism 21 is connected to a discharge oil passage 24, through which the hydraulic oil to be discharged to the oil tank 22 passes.

The vehicle body is equipped with a vehicle control device 25 as a control device and an engine control device 26. The engine control device 26 is electrically connected to the vehicle control device 25. The vehicle control device 25 is electrically connected to a tilt sensor 28 detecting an operating state of a tilting operating member 27 and a lift sensor 30 detecting an operating state of a lifting operating member 29. The tilting operating member 27 is a member for giving an instruction of operation of the tilt cylinders 15, while the lifting operating member 29 is a member for giving an instruction of operation of the lift cylinders 16. Further, an accelerator sensor 32 is electrically connected to the vehicle control device 25. The accelerator sensor 32 detects an accelerator opening degree, which represents the operation amount of accelerator operating member 31. The accelerator operating member 31 is operated when the operator gives an instruction to accelerate the forklift 10. The tilting operating member 27, the lifting operating member 29, and the accelerator operating member 31 are located in the cab of the forklift 10.

The vehicle control device 25 controls the engine speed by outputting a speed instruction of the engine 19 to the engine control device 26. The engine control device 26 controls the engine 19 based on the speed instruction input to the engine control device 26. An engine speed sensor 34 as a first detecting means is electrically connected to the engine control device 26. The engine speed sensor 34 is used to obtain the engine speed. The engine control device 26 outputs the detection result of the engine speed sensor 34 to the vehicle control device 25. The hydraulic pump 20 is driven by the engine 19. Thus, the tilt cylinders 15 and the lift cylinders 16 are actuated when the operator steps on the accelerator operating member 31 and operates the tilting operating member 27 and the lifting operating member 29.

The structure of the hydraulic mechanism 21 will now be described.

The hydraulic mechanism 21 has a control circuit 36, which functions as a first circuit for controlling supply and discharge of pressurized oil, and a pressure compensation circuit 37, which functions as a second circuit for controlling the pressure within the control circuit 36.

The control circuit 36 has a control valve 39 for tilting operation and a control valve 41 for lifting operation. The control valve 39 is connected to the oil chamber of each tilt cylinder 15 via an oil passage 38. The control valve 41 is connected to the oil chamber of each lift cylinder 16 via an oil passage 40. The control valves 39 and 41 are connected to the oil passage 23 and the discharge oil passage 24. The control valves 39, 41 are mechanical switching valves. The tilting operating member 27 is mechanically coupled to the control valve 39. Therefore, when the tilting operating member 27 is operated, the state of the control valve 39 is switched between the open state and the closed state. The lifting operating member 29 is mechanically coupled to the control valve 41. Therefore, when the lifting operating member 29 is operated, the state of the control valve 41 is switched between the open state and the closed state.

Pressurized oil is discharged from the hydraulic pump 20 and flows into the control valves 39 and 41 through the oil passage 23. The pressurized oil is supplied to the oil chambers of the cylinders 15 and 16 through the oil passages 38 and 40. For example, when the tilting operating member 27 is operated, the pressurized oil is discharged from the hydraulic pump 20 and supplied to the oil chamber of each tilt cylinder 15 through the oil passage 38 connected to the control valve 39. The pressurized oil is discharged from the oil chambers of the cylinders 15 and 16 and discharged to the oil tank 22 through the discharge oil passage 24.

The pressure compensation circuit 37 will be described next with reference to FIG. 2.

Figure 2:
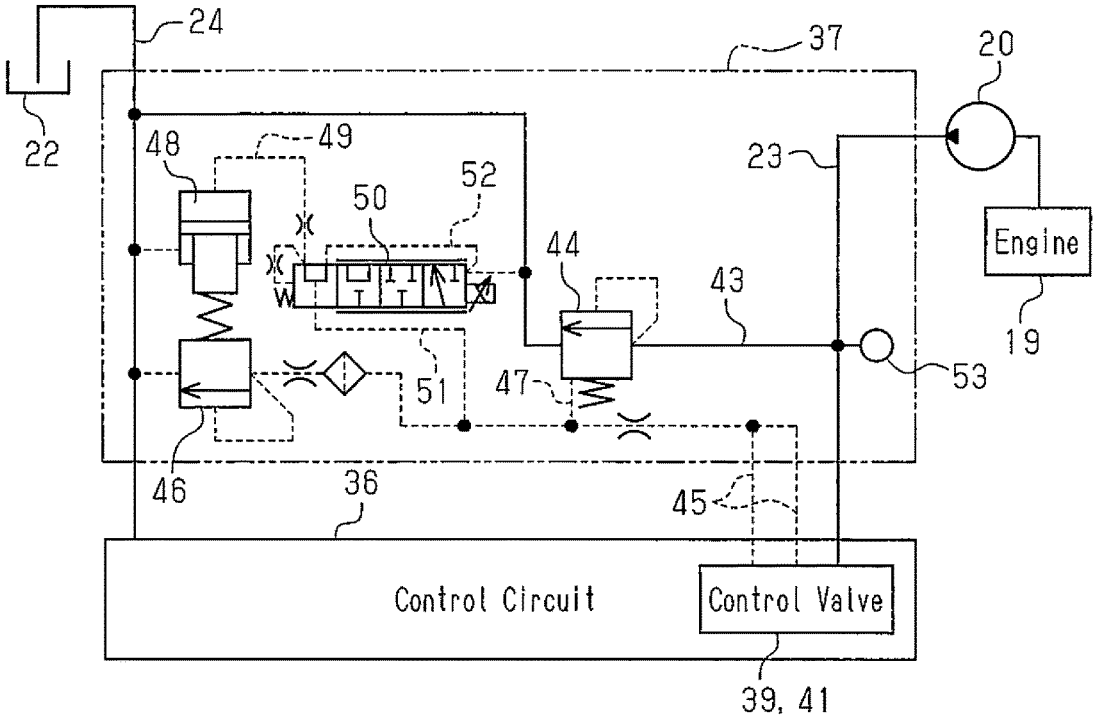
FIG. 2 is a hydraulic circuit diagram explaining a pressure compensation circuit.

As illustrated in FIG. 2, the pressure compensation circuit 37 has an oil passage 43 connected to the oil tank 22. A pressure compensating valve 44 is located on the oil passage 43. The oil passage 43 branches off the oil passage 23, which is connected to a discharge port of the hydraulic pump 20. The oil passage 43 is a second oil passage, which connects the hydraulic pump 20 and the oil tank 22 to each other without the control circuit 36 in between. The pressure compensation circuit 37 includes an oil passage 45, which is connected to the control valves 39, 41. A relief pressure valve 46 is located on the oil passage 45. The oil passage 45 is used to introduce the pressure in the control valves 39, 41 into the pressure compensation circuit 37. The oil passage 45 is a third oil passage, which connects the control valves 39, 41 to the oil tank 22. An oil passage 47 as a fifth oil passage is located on the oil passage 45. The oil passage 47 introduces the pressure in the oil passage 45 into the pressure compensating valve 44. The oil passage 47 is located between the control valves 39, 41 and the relief pressure valve 46.

By means of the pressure introduced through the oil passage 47 and a spring force, the pressure compensating valve 44 generates a pressure that is higher than the pressure introduced into the control circuit 36. Accordingly, the pressure compensating valve 44 supplements the pressure in the control circuit 36 such that the pressure reaches an actuating pressure required for actuating the cargo handling device 11. When the pressure in the oil passage 43 exceeds a predetermined relief pressure, the pressure compensating valve 44 is actuated to connect the hydraulic pump 20 to the oil tank 22. Accordingly, the pressure compensating valve 44 releases the pressurized oil discharged from the hydraulic pump 20 to the oil tank 22. The relief pressure valve 46 is actuated when the pressure in the oil passage 45 exceeds the predetermined relief pressure to release the pressure to the oil tank 22. When the oil passage 45 is opened by actuation of the relief pressure valve 46, the pressure that is introduced into the pressure compensating valve 44 via the oil passage 47 is also lowered. This lowers the relief pressure of the pressure compensating valve 44.

The pressure compensation circuit 37 has an electromagnetic proportional valve 50, which is an electromagnetic valve. The electromagnetic proportional valve 50 is located on an oil passage 49, which is a fourth oil passage connected to a back pressure chamber 48 of the relief pressure valve 46. The electromagnetic proportional valve 50 is electrically connected to the vehicle control device 25. Operation of the electromagnetic proportional valve 50 is controlled by the vehicle control device 25. The electromagnetic proportional valve 50 is connected to an oil passage 51 that is connected to the oil passage 45 and to an oil passage 52 that is connected to the oil passage 43. A pressure sensor 53 is located on the oil passage 23. The pressure sensor 53 functions as a second detecting means for obtaining the discharge pressure of the hydraulic pump 20. The pressure sensor 53 is electrically connected to the vehicle control device 25. The vehicle control device 25 obtains pressure information from the detection result of the pressure sensor 53 and detects the discharge pressure of the hydraulic pump 20.

Hereinafter, operation of the relief pressure valve 46 will be described with reference to FIGS. 2 to 3B.

Figure 3A:
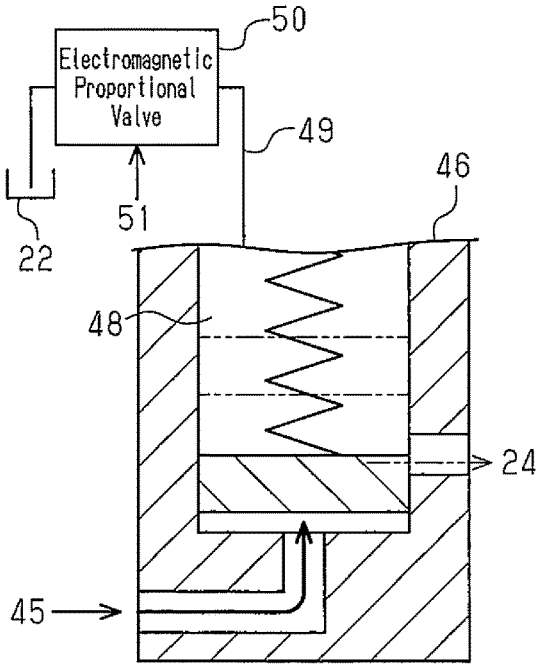
FIGS. 3A and 3B are diagrams explaining operation of a relief pressure valve.
Figure 3B:
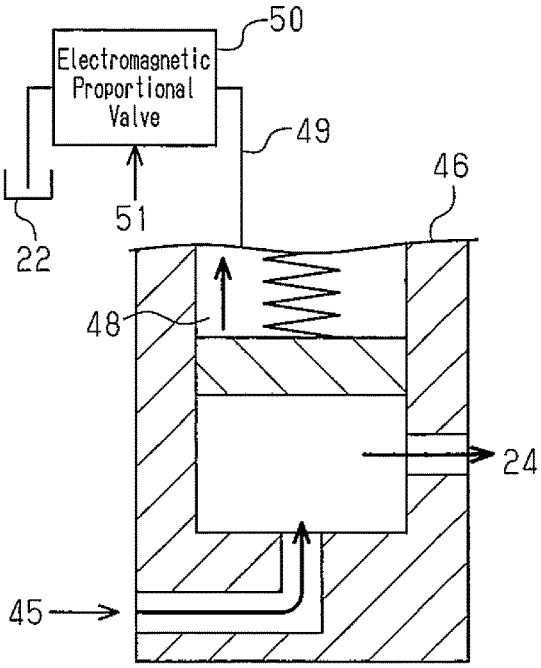

As shown in FIG. 3A, when the pressure of the oil passage 45 is not higher than the relief pressure, the relief pressure valve 46 blocks the oil passage 45 connected to the discharge oil passage 24, as illustrated with solid lines, to not release the pressure to the oil tank 22. In contrast, when the pressure of the oil passage 45 exceeds the relief pressure, the relief pressure valve 46 opens the oil passage 45 as illustrated with long dashed double-short dashed lines, thereby releasing the pressure to the oil tank 22. When the electromagnetic proportional valve 50 is actuated to introduce the pressure of the oil passage 45 into the back pressure chamber 48 via the oil passages 49, 51, the relief pressure of the relief pressure valve 46 is increased by the introduced pressure and the spring force.

When the electromagnetic proportional valve 50 is actuated to release the pressure of the back pressure chamber 48 to the oil tank 22 via the oil passages 49, 52 as shown in FIG.

3B, the relief pressure of the relief pressure valve 46 is lowered. When the pressure of the oil passage 45 exceeds the relief pressure, the relief pressure valve 46 opens the oil passage 45, which is connected to the oil passage 24, thereby releasing the pressure to the oil tank 22. The electromagnetic proportional valve 50 has a structure for opening and closing passages by actuating a spool by means of an electromagnetic force. The electromagnetic proportional valve 50 includes a passage for introducing pressure into the back pressure chamber 48 and a passage for releasing the pressure of the back pressure chamber 48.

When the accelerator operating member 31 is not operated and the speed of the engine 19 is controlled to be the idle speed in the forklift 10, the pressure in the hydraulic mechanism 21 is low. In the forklift 10, in which the engine 19 is used as the drive source for the cargo handling device 11, when a cargo handling operation is performed under a no-load state, for example, when the engine speed is controlled to be the idle speed, the load of the hydraulic pump 20 rapidly increases to activate the hydraulic actuating device. This may result in deficiency of torque of the engine 19, and an engine stall is likely to occur. Therefore, the vehicle control device 25 controls the engine 19 to avoid an engine stall in a state where rapid fluctuation of the load can occur. The cargo handling operation includes operation of the tilt cylinders 15 and operation of the lift cylinders 16. Such cargo handling operation is a load operation that applies a load to the engine 19.

The vehicle control device 25 avoids an engine stall by restricting rapid increase of the pressure in the hydraulic mechanism 21 when a cargo handling operation is performed. Specifically, the vehicle control device 25 uses the pressure compensation circuit 37 to release, to the oil tank 22, the flow of pressurized oil discharged from the hydraulic pump 20, thereby restricting rapid increase of the pressure in the hydraulic mechanism 21. The cargo handling operation includes operation of the tilting operating member 27 and operation of the lifting operating member 29.

Next, the contents of control performed by the vehicle control device 25 to avoid an engine stall will be described with reference to FIG. 4.

The vehicle control device 25 obtains pressure information from the detection result of the pressure sensor 53 (step S10). The vehicle control device 25 is capable of determining whether a cargo handling operation is being performed based on the pressure information. That is, when the discharge pressure of the hydraulic pump 20 is high, the vehicle control device 25 determines that a cargo handling operation is being performed. Also, the vehicle control device 25 obtains engine speed information of the engine 19 from the detection result of the engine speed sensor 34 (step S11).

Next, based on the pressure information and the engine speed information, the vehicle control device 25 determines whether a condition is met in which a cargo handing operation is likely to cause an engine stall (step S12). A condition that is likely to cause an engine stall includes a situation where the engine speed during the cargo handling operation is relatively low and about the idle speed. When the engine speed is low, the load of the hydraulic pump 20 is increased and the torque of the engine 19 tends to be insufficient. This is likely to cause an engine stall. When the condition is met, the vehicle control device 25 makes a positive determination at step S12. On the other hand, when the condition is not met, the vehicle control device 25 makes a negative determination at step S12.

When making a positive determination at step S12, the vehicle control device 25 controls the electromagnetic proportional valve 50 (step S13). Specifically, the vehicle control device 25 actuates the electromagnetic proportional valve 50 to release the pressure of the back pressure chamber 48 to the oil tank 22 via the oil passages 49, 52.

Accordingly, the relief pressure of the relief pressure valve 46 is switched from a value defined by the pressure of the back pressure chamber 48 and the spring force to a value defined by the spring force. As a result, the relief pressure of the relief pressure valve 46 becomes lower than before the pressure of the back pressure chamber 48 is released. When the pressure of the oil passage 45 exceeds the relief pressure, the relief pressure valve 46 is actuated to release the pressure of the oil passage 45 to the oil tank 22.

When the relief pressure valve 46 is actuated to release the pressure of the oil passage 45, the pressure that is introduced into the pressure compensating valve 44 via the oil passage 47 is also lowered. Accordingly, the relief pressure of the relief pressure compensating valve 44 is switched from a value defined by the introduced pressure and the spring force to a value defined by the spring force. As a result, the relief pressure of the pressure compensating valve 44 becomes lower than before the pressure of the back pressure chamber 48 is released. When the pressure of the oil passage 43 exceeds the relief pressure, the pressure compensating valve 44 is actuated to release the pressure of the oil passage 43 to the oil tank 22. That is, when the oil passage 43 is opened, pressurized oil is discharged from the hydraulic pump 20 and flows to the oil tank 22 via the oil passage 43. In this manner, the pressure of the hydraulic mechanism 21 is restricted from being rapidly increased due to a cargo handling operation.

Then, the vehicle control device 25 determines whether the speed of the engine 19 has returned to a predetermined speed based on the engine speed information, thereby determining whether to complete (end) the control (step S14). If the speed of the engine 19 has recovered to a level at which continuation of the cargo handling operation will not cause an engine stall, the vehicle control device 25 makes a positive determination at step S14 and controls the electromagnetic proportional valve 50. Specifically, the vehicle control device 25 actuates the electromagnetic proportional valve 50 to introduce the pressure of the oil passage 45 into the back pressure chamber 48 of the relief pressure valve 46. This increases the relief pressure of the relief pressure valve 46, so that the oil passage 45 is closed. Closing the oil passage 45 increases the pressure introduced into the pressure compensating valve 44, so that the relief pressure of the pressure compensating valve 44 is also increased. As a result, the oil passage 43 is closed and the hydraulic oil is discharged from the hydraulic pump 20 and flows to the control circuit 36. In this manner, the pressure in the hydraulic mechanism 21 returns to the actuating pressure required to actuate the hydraulic actuating device.

The present embodiment achieves the following advantages.

(1) When it is determined that an engine stall is likely to occur based on the pressure information and the engine speed information, the pressure compensation circuit 37 is actuated to release pressurized oil discharged from the hydraulic pump 20 to the oil tank 22. This suppresses a rapid increase of the pressure in the hydraulic mechanism 21. An engine stall is thus avoided.

(2) The above described control is executed based on the pressure information and the engine speed information. In this case, the operating state of the hydraulic actuating device, for example, the operating states of the tilting operating member 27 and the lifting operating member 29, which give instructions of a cargo handling operation, do not necessarily need to be directly detected. This eliminates the necessity for sensors that detect the operating state of a member for giving instructions of a cargo handling operation, and thus reduces the costs of the forklift 10.

(3) The relief pressure of the relief pressure valve 46 is controlled in accordance with the pressure information and the engine speed information. Thus, even if surge pressure occurs, the engine 19 does not receive an abrupt load.

(4) Using the electromagnetic proportional valve 50 to control the relief pressure of the relief pressure valve 46 allows the relief pressure to be controlled to an arbitrary value.

Second Embodiment

A second embodiment of the present invention will now be described with reference to FIG. 5.

In the case of the electromagnetic proportional valve 50, which proportionally controls the opening degree by using a control command value (a current command), hysteresis is preferably taken into consideration. That is, the operation (the opening degree) of the electromagnetic proportional valve 50 is not necessarily always constant in relation to control command values. As a result, when the relief pressure of the relief pressure valve 46 is controlled by operation of the electromagnetic proportional valve 50, the relief pressure is likely to vary due to the hysteresis of the electromagnetic proportional valve 50.

Figure 5:
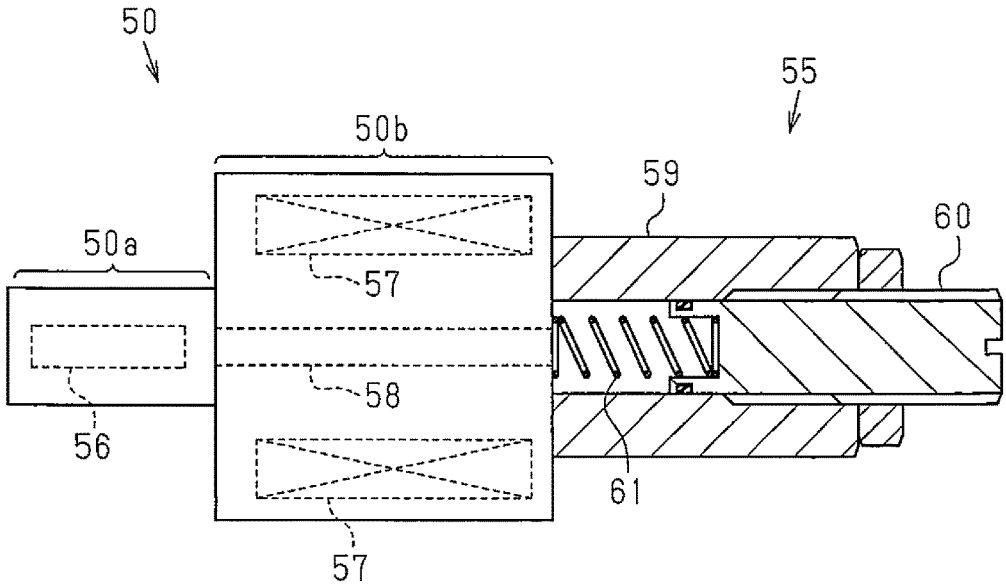
FIG. 5 is a partially cross-sectional view illustrating an electromagnetic proportional valve according to a second embodiment of the present invention.

Thus, as shown in FIG. 5, the electromagnetic proportional valve 50 according to the second embodiment includes an adjusting mechanism 55, which adjusts the opening degree to achieve a desired relief pressure when the hysteresis is taken into consideration.

The electromagnetic proportional valve 50 includes a valve portion 50*a* and a solenoid portion 50*b*. The electromagnetic proportional valve 50 generates a magnetic field by applying a current to a coil 57 of the solenoid portion 50*b*, thereby actuating a plunger 58. The electromagnetic proportional valve 50 slides a spool 56 of the valve portion 50*a* in response to movement of the plunger 58, thereby opening and closing the passage.

The adjusting mechanism 55 includes a cylindrical case 59, a thread portion 60, which is movable in the axial direction within the case 59, and a spring 61 coupled to the thread portion 60. The adjusting mechanism 55 is a mechanical adjusting mechanism that changes the position of the spool 56 via the plunger 58 in accordance with the threaded amount of the thread portion 60. That is, the adjusting mechanism 55 has a structure that adjusts the initial position of the spool 56 in a state where the electromagnetic proportional valve 50 is not actuated in accordance with the threaded amount of the thread portion 60. Thus, when the electromagnetic proportional valve 50 is actuated, the spool 56 is moved with reference to the adjusted position. As the spool 56 moves, the opening degree of the electromagnetic proportional valve 50 is adjusted. Adjustment of the position of the spool 56 by means of the thread portion 60 is carried out such that a desired relief pressure is achieved by controlling the electromagnetic proportional valve 50 with a desired control command value. That is, the position of the spool 56 is adjusted such that the electromagnetic proportional valve 50 is actuated with the opening degree required for achieving the desired relief pressure.

In addition to the advantages (1) to (4) of the first embodiment, the present embodiment achieves the following advantage.

(5) The electromagnetic proportional valve 50 includes the adjusting mechanism 55 that adjusts the opening degree. This allows the electromagnetic proportional valve 50 to be controlled while taking the hysteresis into consideration. That is, since the characteristics of the electromagnetic proportional valve 50 are adjustable, the characteristics achieved by the control command value delivered to the electromagnetic proportional valve 50 and the relief pressure are maintained to be constant.

The above illustrated embodiment may be modified as follows.

In the case of an industrial vehicle that has multiple types of hydraulic actuating devices, such as the tilt cylinders 15 and the lift cylinders 16, the vehicle control device 25 may control the electromagnetic proportional valve 50 such that the relief pressure of the relief pressure valve 46 is varied depending on the hydraulic actuating device that is being operated. For example, the vehicle control device 25 may vary the relief pressure of the relief pressure valve 46 by adjusting the opening degree of the electromagnetic proportional valve 50 depending on the type of the hydraulic actuating device being operated. Specifically, when actuating the tilt cylinders 15, the vehicle control device 25 adjusts the opening degree of the electromagnetic proportional valve 50 such that the relief pressure is lower than that in a case in which the vehicle control device 25 actuates the lift cylinders 16. The opening degree of the electromagnetic proportional valve 50 is adjusted by changing the control command value (the current command) delivered to the electromagnetic proportional valve 50. In this case, the vehicle control device 25 detects the operating state of the tilting operating member 27 or the lifting operating member 29 by using a sensor and identifies which of the hydraulic actuating devices have been operated. For example, the operating state of the tilting operating member 27 can be detected by using the tilt sensor 28, and the operating state of the lifting operating member 29 can be detected by using the lift sensor 30. Also, when the tilt cylinders 15 and the lift cylinders 16 are operated simultaneously, the vehicle control device 25 controls the electromagnetic proportional valve 50 such that the relief pressure of the relief pressure valve 46 conforms to the tilt cylinders 15. This modification allows for setting of a relief pressure suitable for each hydraulic actuating device.

If the first embodiment employs control valves 39, 41 that mechanically couple the tilting operating member 27 and the lifting operating member 29 to each other, sensors for detecting the operating states of the tilting operating member 27 and the lifting operating member 29 do not necessarily need to be provided.

Figure 4:
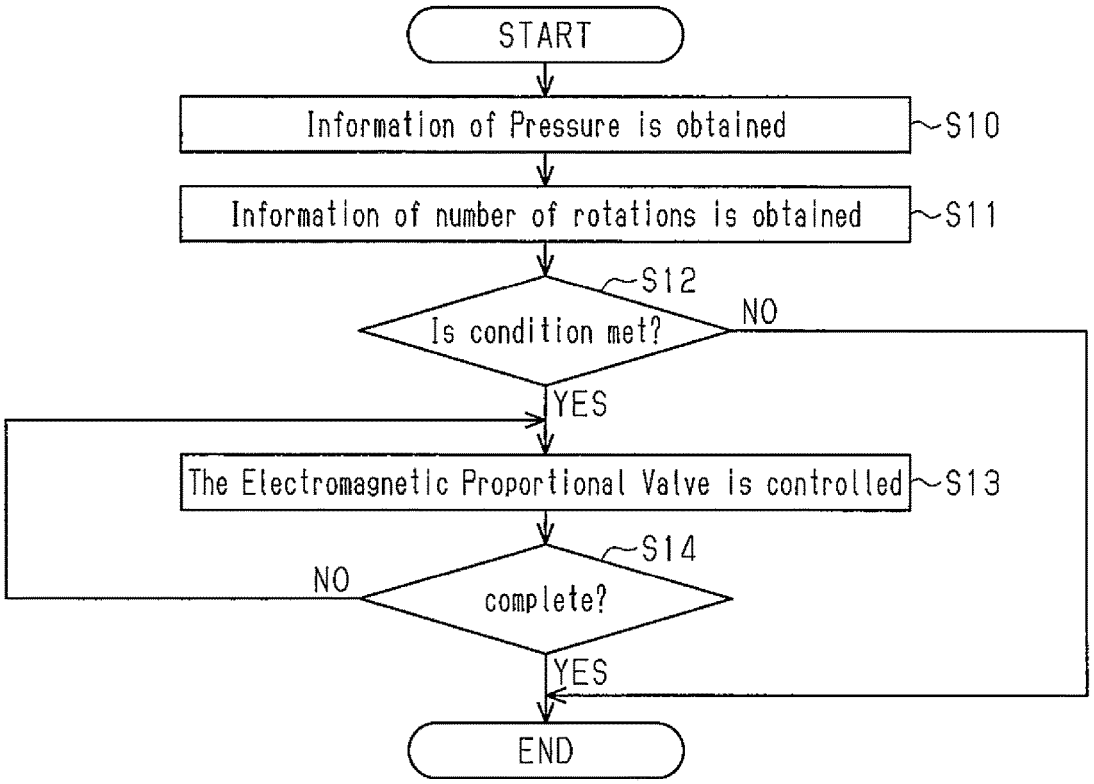
FIG. 4 is a flowchart illustrating a process for starting a cargo handling operation.

The vehicle control device 25 may control the electromagnetic proportional valve 50 in accordance with the elapsed time after actuating the electromagnetic proportional valve 50 to release the pressure of the back pressure chamber 48 of the relief pressure valve 46 to the oil tank 22 (step S13 of FIG. 4).

The pressure sensor 53 may be located at any position in the hydraulic mechanism 21 as long as the pressure sensor 53 can detect the discharge pressure from the hydraulic pump 20.

The forklift 10 may further include a hydraulic cylinder for actuating a power steering mechanism as the hydraulic actuating device.

The forklift 10 may further have a hydraulic cylinder for actuating an attachment operate as the hydraulic actuating device.

The forklift 10 may have both a hydraulic cylinder for actuating an attachment and a hydraulic cylinder for actuating a power steering mechanism.

The industrial vehicle may be a vehicle having a hydraulic actuating device, such as a shovel loader, other than the forklift 10.

The invention claimed is:

1. An industrial vehicle comprising:

an engine;

a hydraulic pump driven by the engine;

an oil tank, which stores hydraulic oil to be pumped by the hydraulic pump;

a hydraulic actuating device actuated by hydraulic pressure;

a first circuit, which includes a control valve and switches supply and discharge of the hydraulic oil by using the control valve, thereby driving the hydraulic actuating device;

a first oil passage, which connects the first circuit to the hydraulic pump;

a second circuit, which controls a pressure in the first circuit;

a first detecting means, which is used to obtain an engine speed;

a second detecting means, which is used to obtain a discharge pressure of the hydraulic pump; and a control device, wherein the second circuit includes a second oil passage, which connects the hydraulic pump to the oil tank without the first circuit in between, a pressure compensating valve, which is located on the second oil passage, a third oil passage, which connects the control valve to the oil tank, a relief pressure valve, which is located on the third oil passage, a fourth oil passage, which is connected to a back pressure chamber of tithe relief pressure valve, an electromagnetic valve, which is located on the fourth oil passage, and a fifth oil passage, which is connected to the third oil passage between the control valve and the relief pressure valve, wherein the fifth oil passage introduces a pressure of the third oil passage into the pressure compensating valve, the control device actuates the electromagnetic valve to open the fourth oil passage when determining that an engine stall is likely to occur based on information of the engine speed obtained from a detection result of the first detecting means and information of the discharge pressure of the hydraulic pump obtained from a detection result of the second detecting means, and the electromagnetic valve opens the fourth oil passage to actuate the pressure compensating valve such that the hydraulic pump is connected to the oil tank.

2. The industrial vehicle according to claim 1, wherein the electromagnetic valve is a proportional valve.

3. The industrial vehicle according to claim 2, wherein the electromagnetic valve includes an adjusting mechanism, which adjusts an opening degree of the electromagnetic valve.

4. The industrial vehicle according to claim 2, wherein the hydraulic actuating device is one of a plurality of hydraulic actuating devices, and the control device detects operation of the hydraulic actuating devices and adjusts an opening degree of the proportional valve according to the type of the hydraulic actuating device that is operating.

* * * * *